United States Patent [19]

Denis

[11] 4,427,187

[45] Jan. 24, 1984

[54] SUPPORTS FOR PRODUCTS IN A STEEL-MAKING FURNACE

[75] Inventor: Michel Denis, Marly le Roi, France

[73] Assignee: Stein Heurtey Societe Anonyme, Ris Orangis, France

[21] Appl. No.: 391,862

[22] Filed: Jun. 24, 1982

[30] Foreign Application Priority Data

Jul. 1, 1981 [FR] France ..... 81 13205

[51] Int. Cl.[3] ..... F27D 3/02

[52] U.S. Cl. ..... 266/274; 432/234

[58] Field of Search ..... 266/274–277; 432/234

[56] References Cited

U.S. PATENT DOCUMENTS 4,080,152 3/1978 Altfeld et al. ..... 432/234

4,290,457 9/1981 Campbell, Jr. ..... 138/149

FOREIGN PATENT DOCUMENTS 1582194 9/1969 France ..... 432/234

753570 7/1956 United Kingdom ..... 266/274

*Primary Examiner*—L. Dewayne Rutledge

*Assistant Examiner*—Christopher W. Brody

*Attorney, Agent, or Firm*—Karl F. Ross; Herbert Dubno

[57] ABSTRACT

The present invention relates to a support for products in a steel-making furnace. This support comprises, over a notable part of its height, but not over the whole of its height, from its base, a peripheral recess in which is housed an insulating envelope, the outer diameter of this envelope being substantially equal to that of the upper part of the stud.

9 Claims, 1 Drawing Figure

SUPPORTS FOR PRODUCTS IN A STEEL-MAKING FURNACE

FIELD OF THE INVENTION

The present invention relates to a support for products in a steel-making furnace.

BACKGROUND OF THE INVENTION

The products, particularly steel slabs, which are heated before rolling in furnaces, are supported on cross-bars or supports cooled by circulation of water or vapour, via supports called studs or lugs.

These studs are generally cylindrical in form and placed on the support tubes at regular intervals and maintained on the tube by welding. Part of the height of the studs is coated by the insulating refractory lining which surrounds the support.

The purpose of the studs is to separate the slab from the support in order to protect the lining from the mechanical shocks which may occur during the movements ensuring advance of the products in the furnace.

The fact of separating the slab from the support also leads to the decrease in the shadow effect of the support on the slab. In fact, the heat transmitted to the slab in the furnace is essentially transmitted by radiation and the proximity of a cooled support, even insulated by a refractory lining, forms an obstacle to the radiation of the furnace on the product. This results in a lower-temperature band on the product, which represents the mark of the support, often known as black mark.

The gap existing between the support and the slab is determined by the height of the stud. It is difficult to increase this height a great deal.

In fact, the part of the stud which emerges from the refractory lining receives the radiation of the furnace and its temperature increases rapidly with height.

For reasons of mechanical strength (resistance to crushing, creeping), it is necessary that the temperature of the stud does not go beyond a certain value, which value is a function of the load supported by the stud when it is in contact with the slab. In fact, it is observed that, if a stud has, from the beginning, a height greater than the usual height, it is rapidly crushed until this value is reached.

It is not possible, on the other hand, to extend the refractory lining of the support up to the upper part of the stud, so as to heat-insulate said stud. In fact, the products, during heating, deposit carbon, due to oxidation and this carbon accumulates on the refractory lining. These must therefore be a sufficient space between the slab and the lining to allow the formation of a slope of carbon which is then maintained at constant height. If this space is insufficient, the carbon transmits to the lining the weight of the slab, which results in destruction of the refractory lining.

OBJECT OF THE INVENTION

It is an object of the present invention to provide a stud for supporting a product in a steel-making furnace, which may have as great a height as is necessary, without reaching a prohibitive temperature.

SUMMARY OF THE INVENTION

This support stud comprises, over a notable part of its height, but not over the whole of its height, from its base, a peripheral recess in which is housed an insulating envelope made of fibrous material, the outer diameter of this envelope being substantially equal to that of the upper part of the stud.

The fibrous insulating envelope of the stud, which is independent of the refractory lining of the support, protects the stud from the radiation of the furnace and renders its temperature virtually independent of its height. The diameter of the upper part of the stud being substantially equal to the diameter of the envelope, this upper part covers the envelope which is very fragile and protects it from the mechanical actions due to the presence of the products supported by the stud, particularly frictions and the deposit of carbon.

The stud is advantageously made of refractory steel, for example cobalt steel. It may be made of one piece. However, it may also comprise a lower element whose height is substantially equal to that of the insulating envelope, and an upper element which is fixed on the lower element and of which the diameter is substantially equal to that of the envelope.

BRIEF DESCRIPTION OF THE DRAWING

The invention will be more readily understood on reading the following description with reference of the accompanying drawings, in which:

The single FIGURE is a view of the stud in axial section.

SPECIFIC DESCRIPTION

Figure 1:
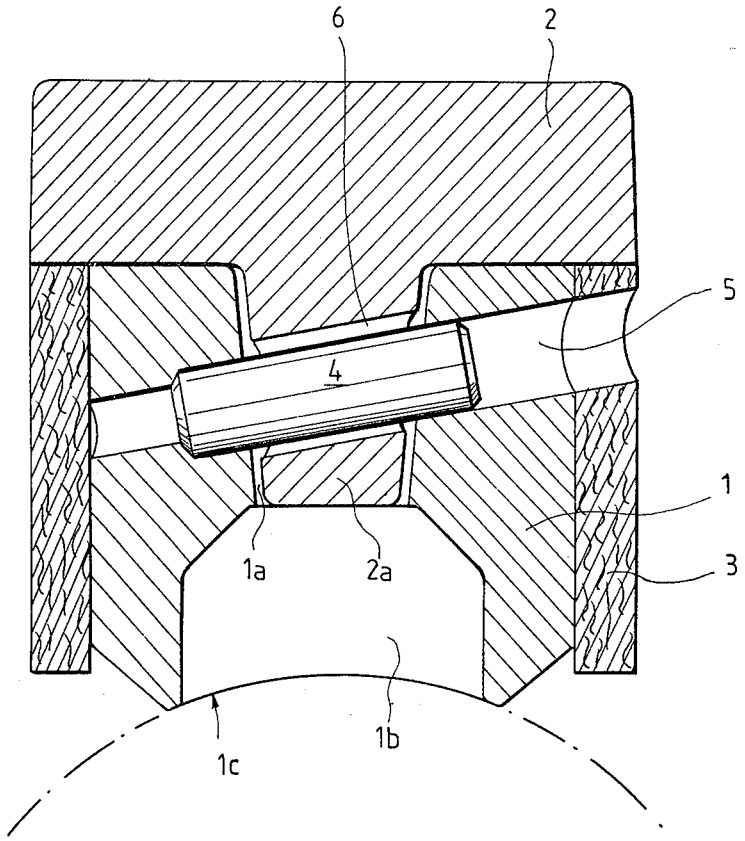
Figure 2:
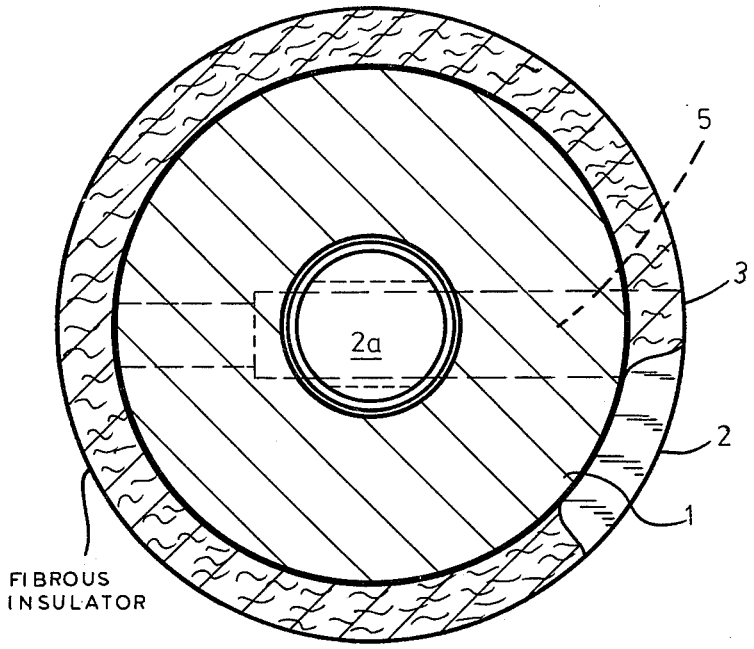

Referring now to the drawing, the stud according to the invention comprises a lower element 1 and an upper element 2; the latter has a larger diameter than that of the element 1, which determines on the periphery of the stud a recess in which is housed an insulating envelope 3, for example of fibrous structure. This envelope extends up to the level of the lower face of the element 2 and its outer diameter is equal to that of this element 2. The elements 1 and 2 are made of refractory steel, for example cobalt steel. The height of the element 2 is approximately included between 0.2 and 0.4 times the total height of the stud.

The upper element 2 comprises at its base a central shank **2*a* passing through an axial hole 1*a* in the element 1. The two elements are fixed to each other by an oblique key 4 which passes through bores 5 and 6 made respectively in the element 1 and in the shank 2*a* of the element 2**.

The element 1 comprises at its base an axial recess **1*b*, which decreases the section offered to the thermal flux coming from the upper element of the stud. Its lower face 1*c* is rounded to correspond to the section of a support. It is adapted to be welded to the support by this rounded face 1*c***.

It is obvious that the present invention is not to be considered as being limited to the embodiment described and shown, but covers, on the contrary, all variants thereto.

What I claim is:

1. A support assembly for steel products in a furnace, comprising:

a water-cooled support extending horizontally in said furnace; and at least one stud projecting upwardly from and mounted on said support for spacing said products from said support while carrying said products in said furnace, said stud comprising:

an upwardly extending cylindrical body having a base secured to said support, an upper part adapted to underlie said products and spaced from said base, and an outwardly peripheral recess extending from said base to said upper part but terminating below a contact surface between said upper part and said products, and a cylindrical insulating envelope composed of fibrous material received in said recess and having substantially the same outer diameter as said upper part.

2. The assembly defined in claim 1 wherein said body is composed of refractory steel.

3. The assembly defined in claim 1 wherein said body comprises a lower part separate from said upper part and having an axial length substantially equal to that of said envelope, said stud further comprising means for securing said upper part to said lower part.

4. The assembly defined in claim 2 wherein said body comprises a lower part separate from said upper part and having an axial length substantially equal to that of said envelope, said stud further comprising means for securing said upper part to said lower part.

5. The assembly defined in claim 3 wherein said upper part has a downwardly extending central shank received in said lower part.

6. The assembly defined in claim 4 wherein said upper part has a downwardly extending central shank received in said lower part.

7. The assembly defined in claim 5 wherein said parts have oblique bores registering with one another, further comprising a fixing key lying in said bores and holding said parts together.

8. The assembly defined in claim 6 wherein said parts have oblique bores registering with one another, further comprising a fixing key lying in said bores and holding said parts together.

9. The assembly defined in claim 1 wherein said body is recessed away from said support where said body is joined to said support.

* * * * *